US007065836B2

(12) United States Patent
Elmer

(10) Patent No.: US 7,065,836 B2
(45) Date of Patent: Jun. 27, 2006

(54) FITTING

(75) Inventor: Hubert Elmer, Innsbruck (AT)

(73) Assignee: Dorma GmbH + Co. KG, Ennepetal (DE)

( * ) Notice: Subject to any disclaimer, the term of this patent is extended or adjusted under 35 U.S.C. 154(b) by 159 days.

(21) Appl. No.: 10/473,904

(22) PCT Filed: Apr. 23, 2002

(86) PCT No.: PCT/EP02/04457

§ 371 (c)(1),
(2), (4) Date: Oct. 3, 2003

(87) PCT Pub. No.: WO02/086265

PCT Pub. Date: Oct. 31, 2002

(65) Prior Publication Data

US 2004/0098835 A1 May 27, 2004

(30) Foreign Application Priority Data

Apr. 23, 2001 (DE) ..... 101 19 898

(51) Int. Cl.
*E05D 3/10* (2006.01)

(52) U.S. Cl. ..... 16/367

(58) Field of Classification Search ..... 16/260, 16/262, 265, 268, 271, 272, 238, 240, 245, 16/246, 252, 253, 342, 367; 52/204.58, 204.65, 52/204.66, 656.4; 49/501, 399, 398, 388; 403/339, 340, 119, 165, 374.1, 377
See application file for complete search history.

(56) References Cited

U.S. PATENT DOCUMENTS

| | | | | |
|---|---|---|---|---|
| 2,462,321 | A | 2/1949 | Holmes | |
| 2,930,075 | A | 3/1960 | Deutchman et al. | |
| 3,921,253 | A * | 11/1975 | Nelson | 16/257 |
| 4,286,352 | A | 9/1981 | Pittasch | |
| 5,588,181 | A * | 12/1996 | Sutton | 16/252 |
| 5,991,975 | A * | 11/1999 | Baer | 16/354 |
| 6,053,458 | A * | 4/2000 | Meyer | 248/74.1 |
| 6,070,294 | A * | 6/2000 | Perkins et al. | 16/252 |
| 6,261,026 | B1 * | 7/2001 | Conley et al. | 403/397 |
| 6,363,547 | B1 * | 4/2002 | Perry | 4/614 |
| 6,678,919 | B1 * | 1/2004 | Sokolov et al. | 16/266 |
| 6,698,061 | B1 * | 3/2004 | Ho | 16/87.2 |
| 6,701,575 | B1 * | 3/2004 | Padiak et al. | 16/309 |
| 6,708,369 | B1 * | 3/2004 | Liao | 16/252 |

FOREIGN PATENT DOCUMENTS

| | | |
|---|---|---|
| DE | 26 29 186 | 1/1978 |
| DE | 94 16 353.7 | 1/1995 |

(Continued)

*Primary Examiner*—Robert J. Sandy
*Assistant Examiner*—André L. Jackson
(74) *Attorney, Agent, or Firm*—Cohen, Pontani, Lieberman & Pavane

(57) ABSTRACT

A fitting for rotatably supporting a closing element for closing an opening, the fitting including a flange, a clamping element for fixing the closing element to the flange, and a pair of arms extending in parallel from the flange and forming an intermediate space therebetween. Each arm extends to a sleeve which can receive the axle therethrough. The flange, the arms, and the sleeves forming a single piece. A ring received between the sleeves can be secured to the axle.

18 Claims, 6 Drawing Sheets

FOREIGN PATENT DOCUMENTS

| | | |
|---|---|---|
| DE | 296 00 610 | 4/1996 |
| EP | 0 599 255 | 6/1994 |
| EP | 0 894 466 | 7/1998 |
| EP | 1 087 147 | 8/2000 |
| GB | 319128 | 9/1929 |
| WO | WO 86/07111 | * 12/1986 |

* cited by examiner

FITTING

PRIORITY CLAIM

This is a U.S. national stage of application No. PCT/EP02/04457, filed on Apr. 23, 2002. Priority is claimed on that application and on the following application: Country: Germany, Application No.: 101 19 898.1, Filed: Apr. 23, 2001.

BACKGROUND OF THE INVENTION

1. Field of the Invention

The invention is directed to a fitting which makes possible the rotatable bearing support of an element at an axle, which element closes an opening.

2. Description of the Related Art

Door leaves made of glass are preferably mounted in a rotatable manner at the top and bottom of glass structures or frame structures by means of fittings. The frame structures are shown in a construction through a vertically extending, fixedly mounted shaft or axle. An arrangement of this kind is known from DE 296 00 610 U1 which shows a fitting for the rotatable bearing support of an element at an axle, which element closes an opening. The fitting has an arm which passes into a sleeve element forming one piece with it, this element being rotatably supported at the axle.

In particular, the cost of manufacturing these complicated fittings is often disadvantageous due to the large number of individual component parts and the fact that they are fabricated by stamping. Further, due to the large number of individual parts, systems of this kind are difficult to assemble and are by no means visually appealing.

It is also difficult to position the door in an exact and long-lasting manner with fittings of this kind. Further, after mounting has been completed the corresponding adjusting devices are visible and constitute an interruption in the surface of the fitting resulting in an overall disjointed visual impression.

SUMMARY OF THE INVENTION

It is the object of the invention to provide an inexpensive fitting with a reduced quantity of individual parts. The resulting individual parts should be compact, universally applicable, stable and visually attractive and capable of being assembled to form a fitting in a simple, adjustable manner, particularly for bearing support of elements made of glass.

According to the invention, the fitting includes a flange, a clamping element for fixing the closing element to the flange, and a pair of arms extending in parallel from the flange and forming an intermediate space therebetween. Each arm extends to a sleeve which can receive the axle therethrough, the flange, the arms, and the sleeves forming a single piece. A ring which is received between the sleeves can be secured to the axle.

The fitting according to the invention has the advantage that the design of a compact and continuously adjustable unit results in an extremely efficient system with regard to use and variability. At the same time, a compact, space-saving and stable mode of construction is ensured. In addition, handling and assembly of structural component parts is substantially simplified. In an advantageous manner, the fitting can easily be adjusted and adapted with respect to its positioning at the axle, also after first-time assembly. In particular, no counter-elements are needed on the axle side when used for furniture systems or shelf systems.

Beyond this, the adjusting and clamping mechanism is not visible to the observer. A visually attractive fitting is provided by means of a concealed arrangement of the adjusting mechanism. The surface of the fitting is formed without interruption in its entirety and can be adapted to the rest of the shape, so that the fitting exhibits visual unity.

The fitting has two arms which extend parallel to one another and pass respectively into a common flange integral therewith so as to form an intermediate space on the one side and are connected to a sleeve element so as to be integral therewith on the other side, this flange having at least one clamping element. In connection with the clamping element, the flange serves to fasten an element which is preferably made of glass. The sleeve elements serve for the rotatable bearing support of the fitting at a fixedly mounted axle. Further, the fitting has a ring which can be secured to the axle and which is arranged in the intermediate space between the two sleeve elements and accordingly also makes it possible to limit the rotational range of the element and to position the fitting.

The arms, including the two sleeve elements, are identical in shape resulting in advantages in technical respects relating to manufacture. Depending on the embodiment form, the arms extend in a straight line or in a curved manner. Arrangements in which the element is arranged inside or outside the plane of the axle can be realized in this way.

In order to increase the stability and load-bearing dependability of the fitting, the sleeve elements, the two arms and the flange are constructed in one piece. Accordingly, screw connections and rivet connections which would represent a weak point are avoided. This one-piece construction can be realized in a simple manner in that these parts are produced as a cast part, so that the possibility of a visually appealing and compact construction is provided at the same time. In particular, the connecting points between the arms and the sleeve elements and between the arms and the flanges can be formed in an advantageous manner, and the load-bearing capacity and reliability are maintained or increased at the same time. On the other hand, the intermediate space between the arms can also be produced by a cutting process, for example, by milling.

The sleeve elements and ring and the axle can be made to engage in one another securely in that their structural shapes complement one another, the sleeve elements and the ring being outfitted with an opening which can advisably be guided over the axle with clearance. This enables easy longitudinal displacement, particularly of the ring, along the axle. In an advantageous construction, the axle as well as the sleeve elements and ring and their openings are round and concentric to one another.

The ring is fixed to the axle by means of a frictional clamping which is invisible to the observer. For this purpose, the ring has a transversely extending, continuous bore hole. Clamping means can be inserted into the bore hole. The bore hole preferably has a female thread into which a stud screw can be screwed, which can be preassembled already during manufacture. An invisible clamping of the ring at the axle is made possible in this way.

The fitting is accordingly constructed in a space-saving and stabile manner also with respect to the use of the clamping means and the construction of the clamping mechanism in connection with the latter. The ring can be fixed relative to the axle with few structural component parts in an easily manageable manner by inserting the clamping means into the bore hole. Disengaging and adjusting the ring, e.g., for vertical or horizontal adjustment of an element, is simple and can also be carried out by untrained installers and users.

Beyond this, the position of the element can be locked relative to the axle on the one hand and can be limited with respect to the swiveling range on the other hand. Limiting the swiveling area is useful particularly for implementing a maximum closing position or opening position. For this purpose, a pin which passes through the intermediate space is inserted between the two arms in the vicinity of the sleeve elements. This pin strikes a projection formed at the ring.

Locking, particularly the locking of a closing position of the element, is likewise carried out through the cooperation of the ring with the sleeve elements. A spring-mounted ball is inserted into a pocket bore hole on the side of the arms that faces the intermediate space, which ball cooperates in a predefined position with a bore hole penetrating the ring. In this way, the element is locked relative to the ring and a defined closing position is provided.

The limiting of swiveling and the locking position can be aligned or adjusted retroactively and in a simple manner. In previous known fittings, these features are realized in an extremely cumbersome and complicated manner.

At least one clamping element is needed to fasten the element to the flange. A first clamping element is preferably realized by means of a tapered or conical nut which can be clamped, with the intermediary of the element constructed as a pane of glass, to the flange and a second clamping element which can be arranged on the rear side in the flange so as to be flush with its surface. In a construction of the fitting, the clamping element can be screwed directly to the flange with the intermediary of the element. In the constructions described above, the element and the first clamping element are arranged on the side facing the observer. According to another construction, the element is located on the side facing away from the observer. The clamping element is countersunk in the flange and is screwed to the oppositely located element. In all of the constructions, the element has a corresponding, preferably stepped, opening for receiving the respective clamping element.

A fastening screw is tightened through the clamping element and through passages in the flange and element by means of a suitable tool. The clamping element can have an elongated hole, while the flange or the second clamping element is provided with a threaded bore hole receiving the fastening screw.

Finally, a cover is placed on the first clamping element. The cover is fastened by means of a clip closure which is integrated in the cover or is a one-piece component of the cover. Integrating in the cover avoids clip elements which make the space located under the cover in the area of the fastening screw more cramped. The cover is advantageously constructed as a plane disk which facilitates production by stamping or punching.

In an embodiment form of the clip closure in which it is integrated in the cover, a flexible ring whose outer diameter slightly exceeds the outer diameter of the cover is arranged in a radially circumferentially extending outer groove of the cover. This flexible ring can be constructed as a snap ring or O-ring. An undercut groove which receives the flexible ring is arranged in the clamping element as a kind of counterpiece to this clip connection.

When constructed as a one-piece component of the cover, it is suggested that the cover has at its outer circumference a circumferentially extending projection which is formed at the cover and which complements the undercut groove of the conical nut. In contrast to the circumferentially extending construction, this projection can be replaced by a plurality of projections which are formed on at the cover and complement the undercut groove of the conical nut.

It has proven advantageous, for example, in order to achieve a fixed bearing, to construct the clamping elements in a cup-shaped manner and to arrange an eccentric bore hole in the base of the cup. A lateral tolerance for compensating with respect to a sub-construction or the like is not required for this purpose.

On the other hand, in order to form a movable or loose bearing it is advisable to arrange an elongated hole in the base of the cup enabling a lateral offset of the fastening screw if required. In any case, the fastening screw can be tightened through the clamping element through the passage created by the missing cover without introducing stresses into the element, preferably a pane of glass. At the same time, it is possible to adjust the element relative to the fitting, particularly so that tolerances can be compensated.

The fitting and its individual parts can be produced from various metals such as brass, iron, stainless steel, aluminum or bronze or from plastics. The fitting and the ring are advantageously manufactured as one-piece parts in a casting process and are subsequently finely machined. The flowing lines of the outer contours reduce production problems relating to casting technique. Further, this prevents projecting edges or corners which pose a risk of injury.

Preferably a plurality of fittings according to the invention are arranged on an element so that this element is arranged securely and rotatably at an axle. The axle is preferably mounted horizontally or vertically in a fixed manner. The vertical positioning is implemented when used on conventional doors and, further, is conceivably a component of shelf systems or furniture systems in which corresponding doors or flaps are likewise rotatably supported on bearings. A horizontal arrangement of the axle is conceivable particularly for systems of this type in order to realize corresponding flaps for closing openings.

In an advantageous construction, a grid system is formed at a surface of the axle, by means of which the ring can be fixed in predefined positions in connection with the clamping means guided through the bore hole. The invention will now be described in more detail with reference to the following possible embodiment examples which are shown schematically.

DETAILED DESCRIPTION OF THE PRESENTLY PREFERRED EMBODIMENTS

Figure 1:
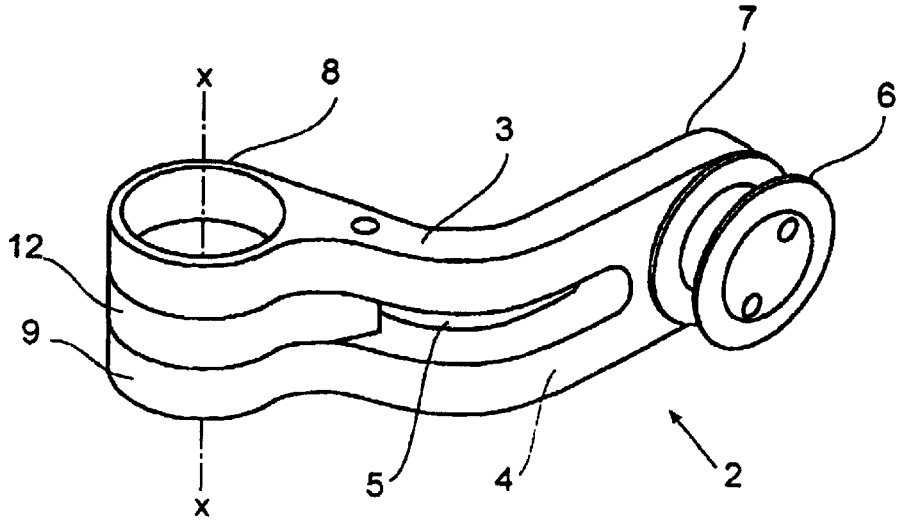
FIG. 1 shows a fitting in a perspective view.

Structural component parts which are identical or function identically are provided with identical reference numbers in the following description.

While several fittings are usually used for the bearing support of an element 1, only one fitting 2 will be shown in detail in the following description. The fitting 2 serves to support elements 1 which are preferably made of glass and which are fastened to an axle, not shown, so as to be rotatable, wherein the axle preferably extends horizontally or vertically. Naturally, elements 1 made of wood, metal or plastic can also be rotatably supported by the fittings 2. The elements 1 can be realized as doors or as closure flaps inside furniture or showcases. In the following description, it is assumed that the axle has a round cross section.

The fitting 2 is preferably made of a metallic material as a cast part. It comprises two arms 3 and 4 which are arranged parallel to one another and which enclose an intermediate space 5 between them. On one side, the fitting 2 passes into a flange 7 so as to form one piece with it, this flange 7 having at least one clamping element 6, and, on the other side, each arm 3, 4 passes into a sleeve element 8, 9 so as to form one piece with it. The sleeve elements 8 and 9 are identically shaped and have a common center axis X. Further, the sleeve elements 8 and 9 are round and each have a concentrically arranged circular opening 10, 11 which can be guided at the axle without play during and after assembly. The arms 3, 4 are likewise identically shaped.

A circular ring 12 belonging to the fitting 2 likewise has a circular, concentrically arranged opening 13. The ring 12 is penetrated radially by a bore hole 14 which extends transverse to opening 13 and terminates in opening 13. A female thread is formed in the bore hole 14, so that clamping means 15 in the form of a stud screw can be screwed in.

Further, a radially projecting projection 16 is formed at the ring 12 and cooperates with a pin 17 between the arms 3 and 4. The projection 16 is penetrated by a bore hole 18 extending parallel to the center axis X of the opening 13.

The pin 17 penetrating the intermediate space 5 is formed between the two arms 3 and 4 in the vicinity of the sleeve elements 8 and 9 and cooperates with the projection 16 formed at the ring 12. Further, a spring-mounted ball 19, 20 is formed in the immediate vicinity of the sleeve elements 8 and 9 on the side facing the intermediate space 5 in an invisible pocket bore hole. The balls 19 and 20 cooperate with the bore hole 18 inside the ring 12 and form a position lock.

The arms 3 and 4 are connected tangentially at the flange 7. At least one clamping element 6 is needed to fasten the element 1 to the fitting 2, which element 1 is preferably made of glass. The clamping element 6 is formed as a conical nut and is inserted from the side of the fitting 2 facing the observer in all of the embodiment examples.

Figure 2:
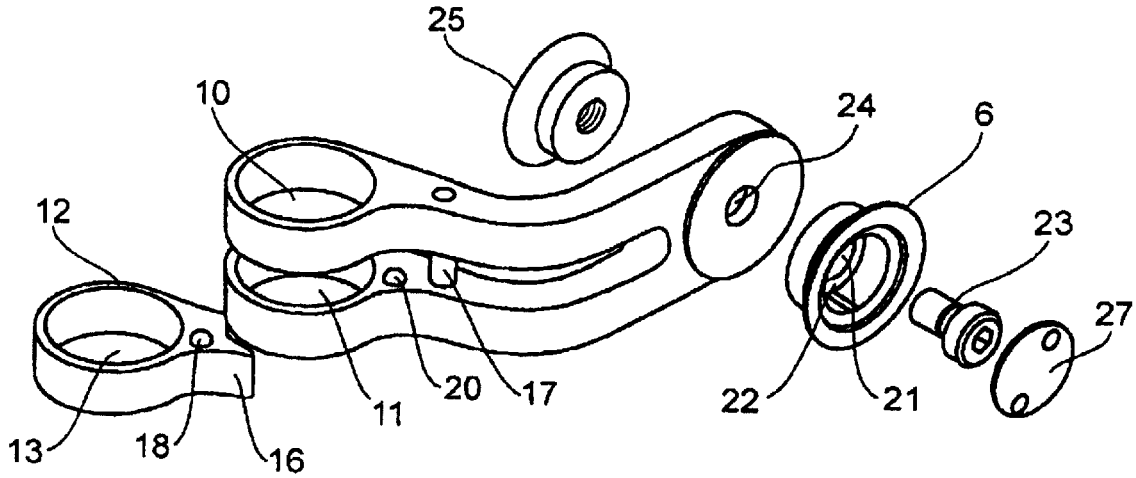
FIG. 2 is an exploded view of the fitting according to FIG. 1.
Figure 3:
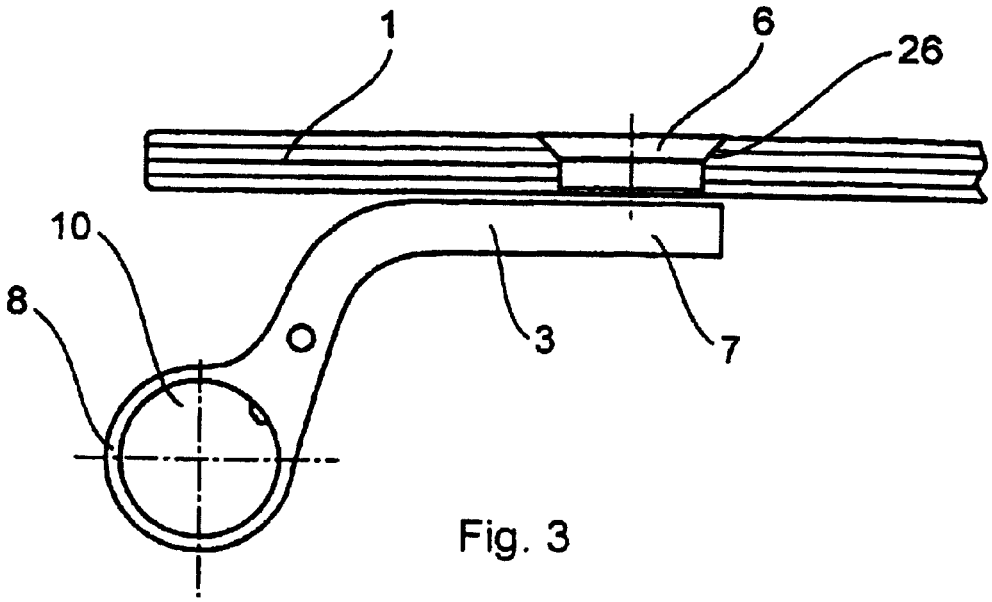
FIG. 3 is a top view of the fitting according to FIG. 1.
Figure 4:
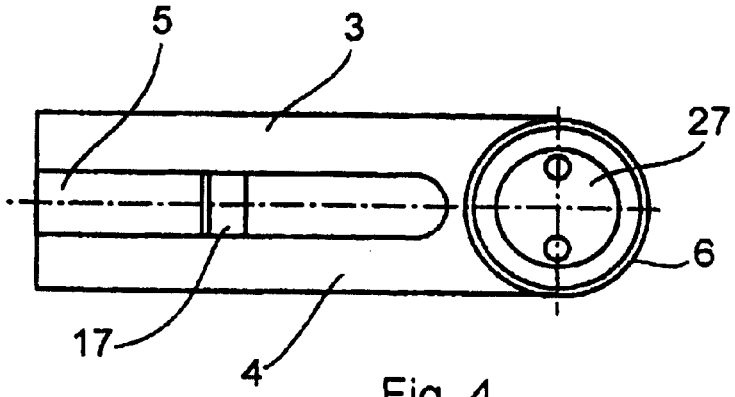
FIG. 4 is a front view of the fitting according to FIG. 1.
Figure 5:
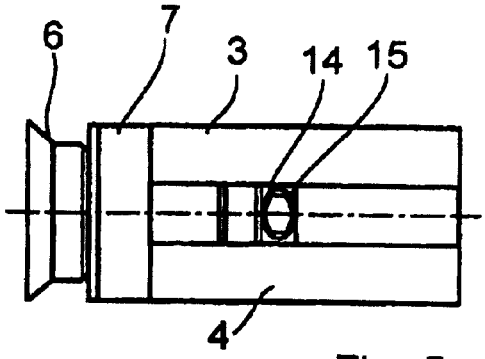
FIG. 5 is a side view of the fitting according to FIG. 1.

FIGS. 1 to 5 show a construction in which the element 1 lies visibly in front of the fitting 2, the arms 3, 4 jutting out in a curved manner. An elongated hole 21 in a base 22 of the conical nut 6 is penetrated by a fastening screw 23. The fastening screw 23 further penetrates an opening 24 inside the flange 7 with the intermediary of the element 1 and cooperates with a second clamping element 25 that is arranged on the back of the flange 7. The element 1 has a stepped, positive-locking glass recess 26 corresponding to the clamping element 6, so that the conical nut 6 is arranged flush with the plane of element 1 after finally being screwed together with the second clamping element 25. The second clamping element 25 then also lies within a recess, not shown, so as to be flush with the surface and in a positive engagement on the rear of the fitting 2. The fastening screw 23 can be turned by means of a suitable tool through the conical nut 6 with the cover 27 removed. The cover 27 is formed as a plane disk which can be clipped in after assembly.

Figure 6:
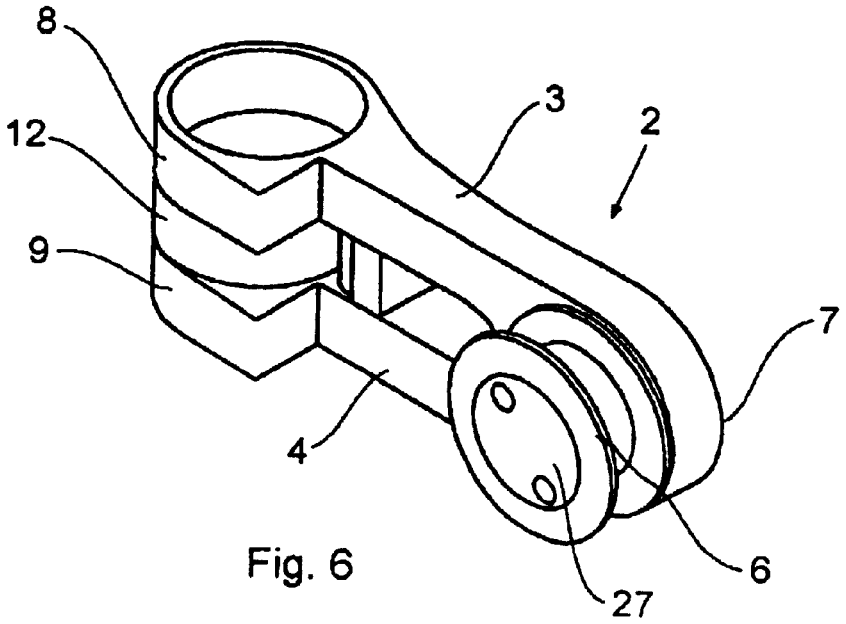
FIG. 6 is a perspective view of another embodiment example of a fitting.
Figure 7:
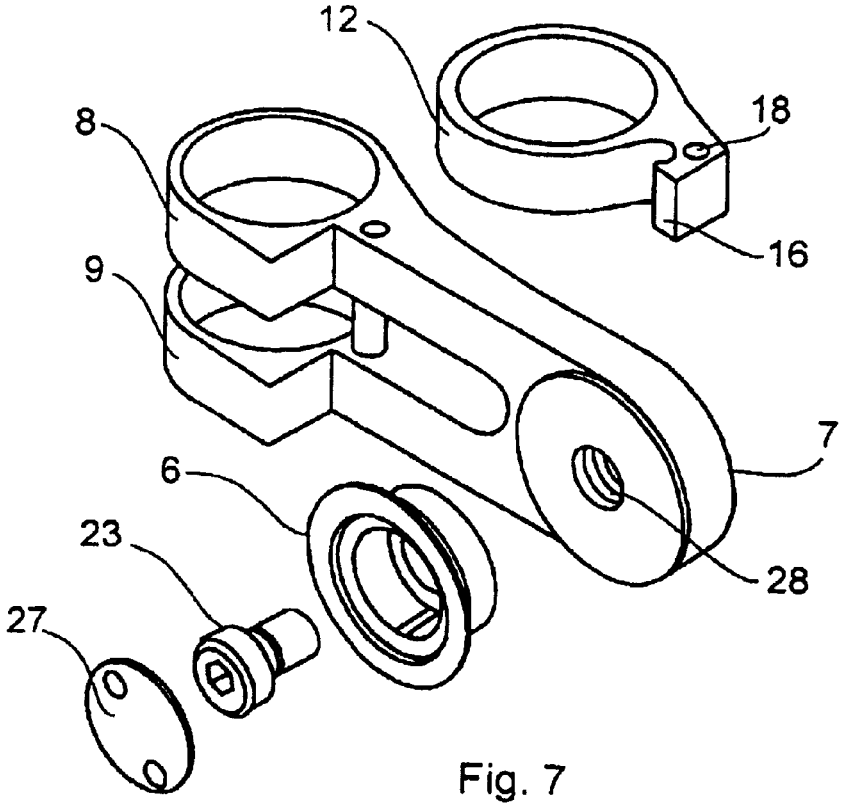
FIG. 7 shows an exploded view of the fitting according to FIG. 6.
Figure 8:
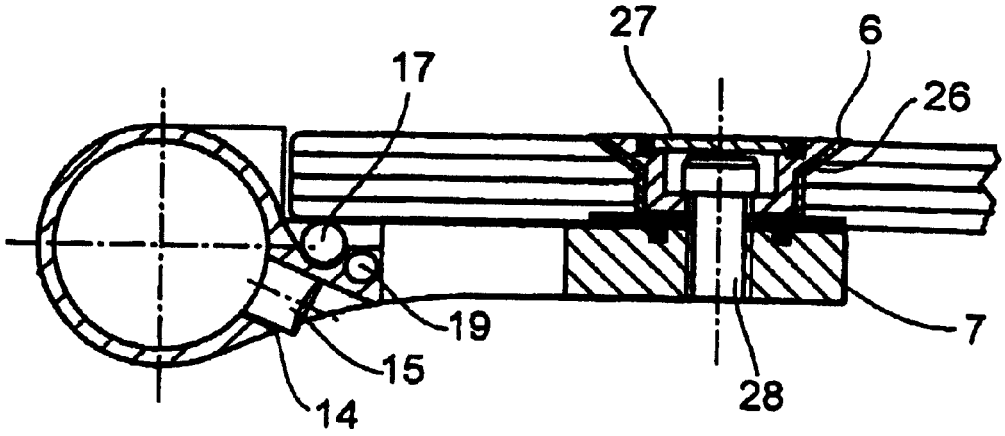
FIG. 8 shows a top view of the fitting according to FIG. 6.
Figure 9:
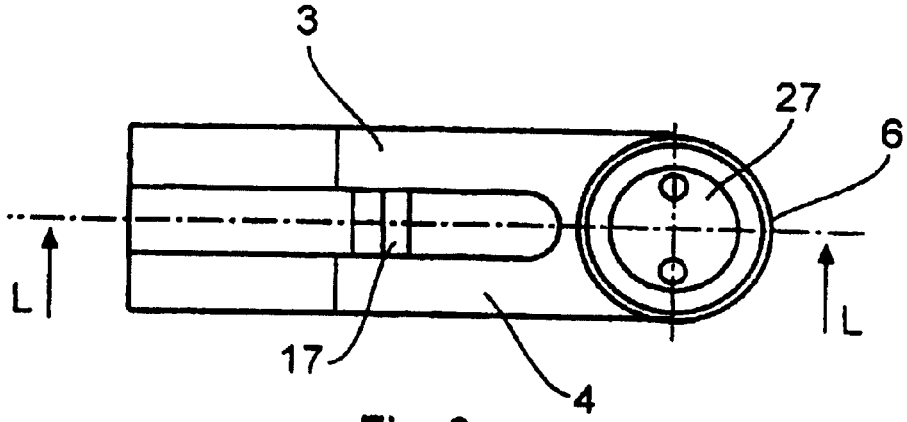
FIG. 9 shows a front view of the fitting according to FIG. 6.
Figure 10:
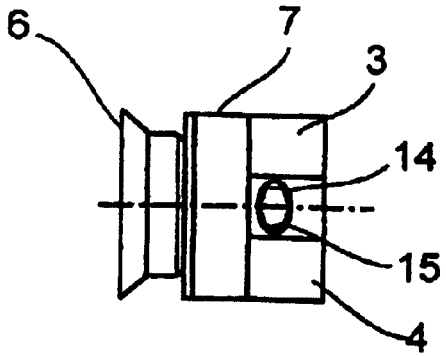
FIG. 10 shows a side view of the fitting according to FIG. 6.

FIGS. 6 to 10 show a construction in which the element 1 is visibly in front of the fitting 2. The arms 3 and 4 extend in a straight line, so that the element 1 and the axle are arranged in a plane. The projection 16 is beveled at the ring 12 so as to receive the element 1 in a visually pleasing manner.

The element 1 is fastened directly to the flange 7 by means of the conical nut 6. The fastening screw 23 penetrates the elongated hole 21 at the base of the conical nut 6 and cooperates with the threaded bore hole 28 inside the flange 7 with the intermediary of element 1. The element 1 has a stepped positive-locking glass recess 26 corresponding to the clamping element 6, so that the conical nut 6 is arranged flush with the plane of element 1 after finally being screwed together with the flange 7. The fastening screw 23 can be turned by means of a suitable tool through the conical nut 6 with the cover 27 removed. The cover 27 is formed as a plane disk which can be clipped in after assembly.

Figure 11:
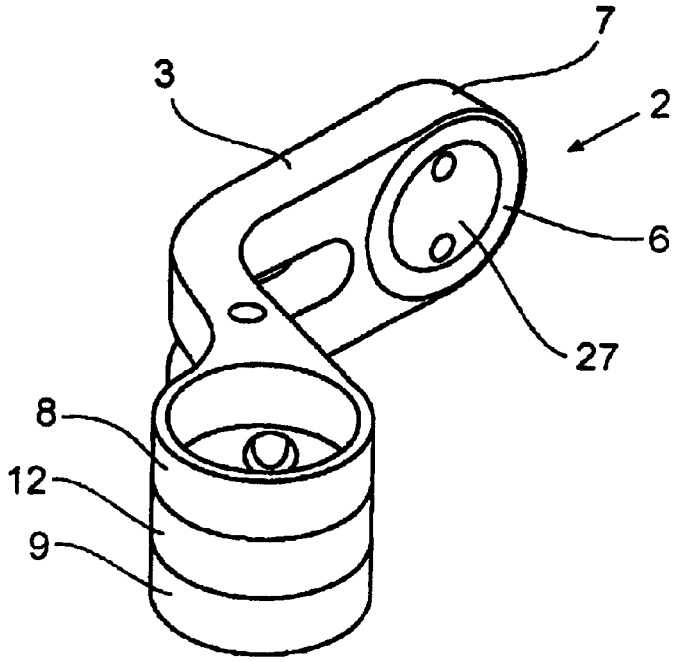
FIG. 11 shows a perspective view of another embodiment example of a fitting.
Figure 12:
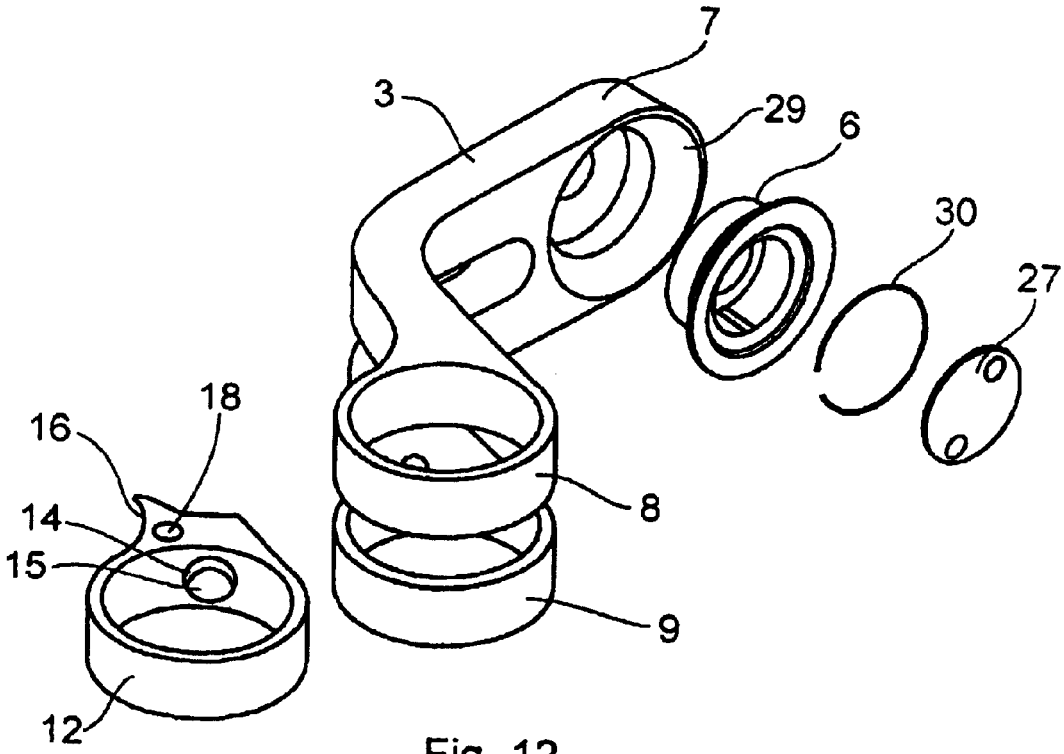
FIG. 12 shows an exploded view of the fitting according to FIG. 11.
Figure 13:
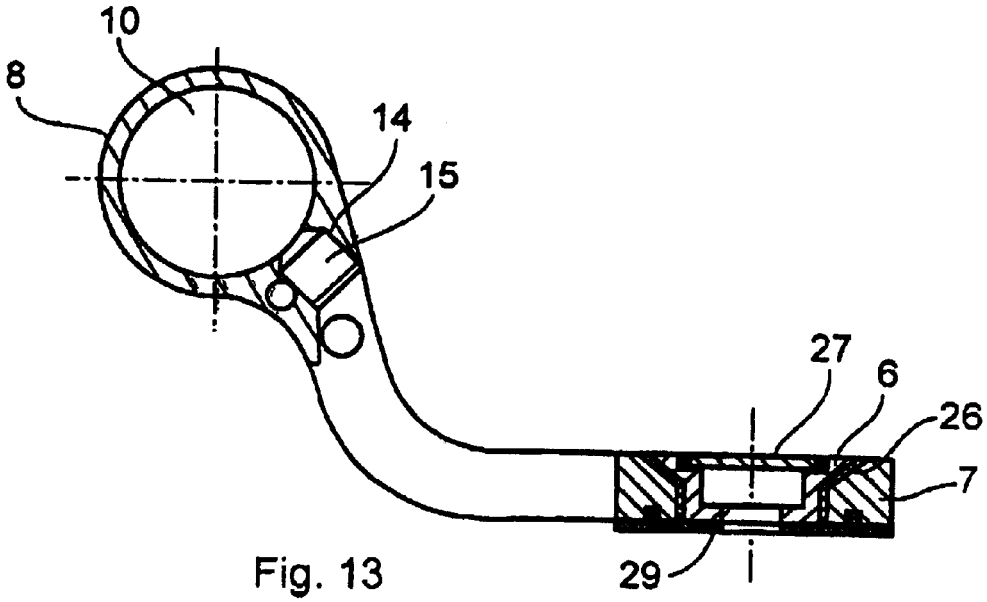
FIG. 13 shows a top view of the fitting according to FIG. 11.
Figure 14:
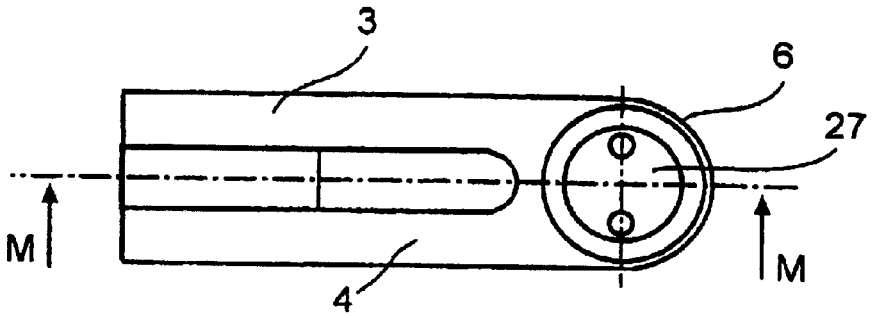
FIG. 14 shows a front view of the fitting according to FIG. 11.
Figure 15:
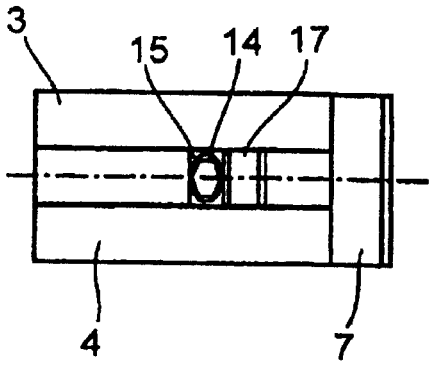
FIG. 15 shows a side view of the fitting according to FIG. 11.

FIGS. 11 to 15 show a construction in which the element 1 is located behind the fitting 2 and the arms 3 and 4 project out in a curved manner. The conical nut 6 is inserted in a positively engaging manner into a corresponding recess 29 of the flange 7 on the front so as to be flush with the surface. The elongated hole 21 in the base 22 of the conical nut 6 is penetrated by a fastening screw 23 which, with the intermediary of element 1, cooperates on the back with a second clamping element (not shown) which can be screwed into a corresponding glass recess 26 of the element 1 in a positive engagement. The element 1 has a stepped positive-locking glass recess 26 corresponding to the clamping element, so that the second clamping element is arranged flush with the plane of element 1 after the final screwing together. The fastening screw 23 can be turned by means of a suitable tool through the conical nut 6 with the cover 27 removed. The cover 27 is formed as a plane disk and has a radially circumferentially extending outer groove in which a flexible ring 30 is embedded. The outer diameter of the flexible ring 30 is slightly greater than the outer diameter of the cover 27. The flexible ring 30 can also be a snap ring or O-ring.

The fitting 2 is fastened to a rotatably mounted axle. For this purpose, fittings are fastened to the element 1 by means of the clamping elements 6, 25 in the manner described above, depending upon the construction, in a preassembly step. This unit that is prefabricated in this way is then outfitted with the corresponding rings 12. This is carried out in such a way that the rings 12 are fixed between the corresponding sleeve elements 8, 9 in a mounting position, preferably so as to be locked by the ball suspension. The fittings 2, including the element 1, are then guided over the axle. The sleeve elements 8, 9 and the rings 12 are then oriented in an aligned position, so that they can be guided over the axle without a problem. The rings 12 are then clamped in the desired position at the axle; in so doing, it is possible to carry out the vertical positioning as well as angular positioning of the fitting 2. For angular positioning, it is useful to hold the element 1 for one time only in the closed position and orient the ring 12 in a corresponding manner, so that the angular limiting and locking act in a predetermined manner. The frictionally engaging clamping of the ring 12 is carried out in such a way that the stud screw 15 which is premounted already during manufacture and is countersunk in the ring 12 so as to be invisible is screwed in against the axle by the installer, so that a frictionally engaging clamping of the ring 12 is carried out. All of the rings 12 associated with an element 1 are fixed to the axle in this way, so that the fitting 2 is held on the axle.

The uses described in the embodiment examples represent only some of the ways in which the invention can be realized. Other different construction and installation scenarios are possible and likewise cover the protective field of the invention.

What is claimed is:

1. A hinged element comprising:

a fitting comprising a flange, a pair of arms extending in parallel from said flange and forming an intermediate space therebetween, each said arm extending to a sleeve which can receive an axle therethrough, said flange, said arms, and said sleeves forming a single piece, and a ring which is received between said sleeves and can be secured to said axle so that said single piece is pivotal about an axis extending through said sleeves;

a closing element for closing an opening;

a pair of clamping elements fastening said closing element to said flange, one of said clamping elements being set in a recess in one of said closing element and said flange for connecting said closing element to said flange;

a cover fitted to said one of said clamping elements so that said cover is flush with said one of said closing element and said flange; and a clip closure for detachably fastening said cover to said one of said clamping elements, wherein said cover comprises a circumferential groove, said clip closure comprising a flexible ring seated in said circumferential groove.

2. The hinged element of claim 1, wherein said one of said clamping elements comprises an undercut groove which receives said flexible ring.

3. The hinged element of claim 1, wherein said flexible ring is one of a snap ring and an O-ring.

4. The hinged element of claim 1, wherein said cover is a plane disk.

5. The hinged element of claim 1, wherein said one of said clamping elements is a cup-shaped element having a bottom provided with an elongate hole.

6. The hinged element of claim 1, comprising a plurality of said fittings fastened to said closing element.

7. A fitting for rotatably supporting a closing element for closing an opening, said fitting comprising:

a flange;

a clamping element for fixing said closing element to said flange;

a pair of arms extending in parallel from said flange and forming an intermediate space therebetween, each said arm extending to a sleeve which can receive an axle therethrough, said flange, said arms, and said sleeves forming a single piece; and a ring which is received between said sleeves and can be secured to said axle so that said single piece is pivotable about an axis extending through said sleeves, wherein said ring has a threaded radially extending bore which receives a stud screw for fixing said ring to said axle.

8. The fitting of claim 7, wherein said sleeves and said ring have concentric round openings which receive said axle in a complementary manner.

9. The fitting of claim 7, wherein said arms are identically shaped.

10. The fitting of claim 7, wherein said arms are straight.

11. The fitting of claim 7, wherein said arms are curved.

12. The fitting of claim 7, further comprising means for positioning said ring with respect to said arms.

13. The fitting of claim 12, wherein said means for positioning said ring with respect to said arms comprises a pin extending across said intermediate space between said arms, and a projection formed on said ring.

14. The fitting of claim 12, wherein said means for positioning said ring with respect to said arms comprises at least one spring loaded ball which is seated in at least one of said arms and said ring.

15. The fitting of claim 14, further comprising a second spring loaded ball, wherein said at least one and second balls being mounted in respective arms, said ring having a bore cooperating with said at least one and second spring loaded balls.

16. A fitting for rotatably supporting a closing element for closing an opening, said fitting comprising:

a flange;

a clamping element for fixing said closing element to said flange;

a pair of arms extending in parallel from said flange and forming an intermediate space therebetween, each said arm extending to a sleeve which can receive an axle therethrough, said flange, said arms, and said sleeves forming a single piece; and a ring which is received between said sleeves and can be secured to said axle; and at least one spring loaded ball seated in at least one of said arms and said ring and operable to position said ring with respect to said arms in a predetermined position.

17. The fitting of claim 16, further comprising a second spring loaded ball, wherein said at least one and second balls being mounted in respective arms, said ring having a bore cooperating with said at least one and second spring loaded balls so as to ensure the predetermine position of said ring with respect t said arms.

18. A fitting for rotatably supporting a closing element for closing an opening, said fitting comprising:

a flange;

a clamping element for fixing said closing element to said flange;

a pair of arms extending in parallel from said flange and forming an intermediate space therebetween, each said arm extending to a sleeve which can receive an axle therethrough, said flange, said arms, and said sleeves forming a single piece;

a ring which is received between said sleeves and can be secured to said axle;

a pin extending across said intermediate space between said arms; and a projection formed on said ring and cooperating with said pin so as to position said ring with respect to said arms in a predetermined position.

* * * * *